US007107753B2

(12) United States Patent
Fischer et al.

(10) Patent No.: US 7,107,753 B2
(45) Date of Patent: Sep. 19, 2006

(54) HEATING DEVICE FOR HEATING A YARN

(75) Inventors: Martin Fischer, Solingen (DE); Siegfried Morhenne, Breckerfeld (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/122,118

(22) Filed: May 4, 2005

(65) Prior Publication Data

US 2005/0193711 A1 Sep. 8, 2005

Related U.S. Application Data

(63) Continuation of application No. PCT/EP03/13287, filed on Nov. 26, 2003.

(30) Foreign Application Priority Data

Dec. 4, 2002 (DE) ..... 102 56 540

(51) Int. Cl.
*D02G 3/02* (2006.01)

(52) U.S. Cl. ..... 57/284; 57/290

(58) Field of Classification Search ..... 57/284, 57/290; 34/624; 28/249; 219/388
See application file for complete search history.

(56) References Cited

U.S. PATENT DOCUMENTS

| | | | | |
|---|---|---|---|---|
| 3,071,838 | A | 1/1963 | Scragg | |
| 4,236,323 | A | 12/1980 | Dammann et al. | |
| 5,148,666 | A | 9/1992 | Baurer et al. | |
| 5,718,109 | A | 2/1998 | Fujita | |
| 2002/0070207 | A1 * | 6/2002 | Morhenne et al. | 219/388 |

FOREIGN PATENT DOCUMENTS

| | | |
|---|---|---|
| DE | 23 48 371 | 4/1975 |
| DE | 31 01 925 A1 | 4/1982 |
| DE | 44 09 358 A1 | 9/1995 |
| EP | 0 412 429 A2 | 2/1991 |
| GB | 2 014 622 A | 8/1979 |

* cited by examiner

*Primary Examiner*—Shaun R. Hurley
(74) *Attorney, Agent, or Firm*—Alston & Bird LLP

(57) ABSTRACT

A heating device for heating a yarn, in particular in a texturing machine. The heating device comprises a thin-walled heating tube, which can be evenly heated on its circumference by a heating jacket. Fitted within the peripheral wall of the heating tube is an insert, which forms a yarn channel extending between a yarn inlet and a yarn outlet for guiding the yarn. The insert is formed by a special section rail that is open along one long side, and fitted with its opposite long side to the wall of the heating tube. As a result, the yarn channel is formed between the open long side of the special section rail and the wall of the heating tube, so that it is possible to supply heat to the yarn channel directly via the wall of the heating tube.

9 Claims, 3 Drawing Sheets

HEATING DEVICE FOR HEATING A YARN

CROSS REFERENCE TO RELATED APPLICATION

The present application is a continuation of international application PCT/EP2003/013287, filed 26 Nov. 2003, and which designates the U.S. The disclosure of the referenced application is incorporated herein by reference.

BACKGROUND OF THE INVENTION

The invention relates to a heating device for heating a yarn, in particular in a yarn texturing machine.

For texturing a synthetic filament yarn, it is known to heat the yarn in a texturing machine by means of a heating device for texturing and drawing and for subjecting the yarn to a shrinkage treatment. As a function of the process step, different heating devices have been developed, which produce an optimal heating of the yarn in the particular process. Thus, for obtaining a high relaxation effect in the yarn during the shrinkage treatment, it is necessary that the yarn advance through the heating device as much as possible under no tension. For this process step, especially such heating devices have proved successful, in which the yarn advances through a yarn channel that is provided within a heating tube. Heating devices of this type are known, for example, from DE 23 48 371, or DE 31 01 925 A1. In these heating devices, the heating tube is formed by a thin-walled tube, which is surrounded by a heating jacket that is filled with a heat transfer medium. For guiding the yarn, the heating tube accommodates a tubular insert, which includes a yarn channel. In this process, the yarn is heated by convection, preferably in a noncontacting relationship. However, devices of this type are also known for heating the yarn in contacting relationship.

Basically, with such heating devices there arises the problem that the heat generated on the circumference of the wall of the heating tube by the condensation of the heat transfer medium, must be guided through the wall of the heating tube and through the wall of the insert for entering the yarn channel. To this end, it is necessary to fit the tubular insert into the heating tube as tightly as possible without leaving any gaps, so as to avoid heat transfer losses. However, since it is preferred to mount the inserts in the heating tube in an exchangeable manner, it is, for example, not possible to press them in for obtaining narrow gaps and satisfactory heat transfers.

When texturing and drawing yarns, it is preferred to use heating devices, as are disclosed, for example, in EP 0 412 429 A1 and corresponding U.S. Pat. No. 5,148,666. During the texturing and drawing processes, the yarns advance under a high tension while being heated. In this connection, the yarns exhibit natural dynamics, so that the yarn guidance becomes an exacting task. Heating devices of this type are preferably constructed as high-temperature heaters, in which the yarns advance in a heating groove with yarn guide elements. The sides and the bottom of the heating groove are heated by resistance elements, with the heating surface having a temperature that is above the melt point of the yarn material. For this reason, the yarns are kept at a distance from the heating surface. However, to heat a yarn in a tension free state, such heating devices are barely suitable, since each unintended contact with one of the heating surfaces directly results in damage to filaments of the yarn.

It is therefore an object of the invention to further develop a heating device of the foregoing type for heating a yarn, in particular during a shrinkage treatment in a texturing machine, such that it permits transferring heat into the yarn channel with the least possible losses.

A further object of the invention is to achieve in the yarn channel the highest possible yarn temperatures while using the energy generated by a heating jacket.

SUMMARY OF THE INVENTION

The invention has the special advantage that within a yarn channel, a separation exists between the function of the yarn guidance and the heat transfer. Thus, an insert that is needed for guiding the yarn extends along a partial length of the wall of the heating tube. The remaining partial length of the heating tube wall directly adjoins the yarn channel, so that the heat can be directly transferred from the wall of the heating tube into the yarn channel. To ensure that the yarn does not come into direct contact with the wall of the heating tube, a special section rail constitutes the insert, whose open long side forms a guideway for the yarn. In this arrangement, the yarn channel extends between the open long side of the special section rail and the wall of the heating tube. With its opposite long side, the special section rail is directly fitted to the wall of the heating tube. Thus, the wall of the heating tube may be formed of a material, which permits an optimal heat transfer. An unacceptable wear by yarn contact is avoided by the special section rail, which in turn is formed of a material that is suitable for guiding the yarn. The only partially covered wall of the heating tube makes it thus possible to improve the heat input into the yarn channel considerably. It was thus possible to observe that one could reach a higher yarn temperature in the yarn channel than in the known devices.

To advance a yarn through the yarn channel in contact therewith, it will be especially advantageous to widen the yarn channel by a longitudinal groove which is formed along the open long side of the special rail section, with the yarn preferably advancing along the bottom of the groove. It is also desirable to provide the groove with a curvature that extends in the direction of the advancing yarn, so that a yarn advancing under no tension safely travels through the yarn channel and can be uniformly heated. In this connection, it should be considered that one needs to form the curvature only in the special section rail, whereas the heating tube has an unbent, straight shape.

To realize a plurality of heating zones in the heating device, it is preferred to use the advantageous further development wherein the longitudinal groove of the special section rail or the special section rail itself comprises a plurality of partial lengths one following the other in the direction of the yarn advance. For example, it would be thus possible to form preferably a heating zone with yarn contact and a heating zone without yarn contact.

The further development of the invention, in which the special section rail is exchangeably held in the heating tube, has the special advantage that it permits changing the yarn guideway and cleaning the yarn guiding surfaces in a simple way.

In this case, it is easy to arrange a plurality of guide elements in spaced relationship along the open long side of the special section rail. The guide elements, which may be formed, for example, by ceramic inserts, permit a high flexibility in the yarn advance within the heating device. In this connection, the guide elements may extend over the entire length of the special section tube or over a partial length thereof.

The special section rail and the heating tube may have any desired shape. However, it is preferred to make the heating tube tubular. The tube itself may be straight or bent.

BRIEF DESCRIPTION OF THE DRAWINGS

In the following, further advantages of the invention are described in greater detail by means of several embodiments of the device according to the invention with reference to the attached drawings, in which.

DETAILED DESCRIPTION OF THE PREFERRED EMBODIMENTS

Figure 1:
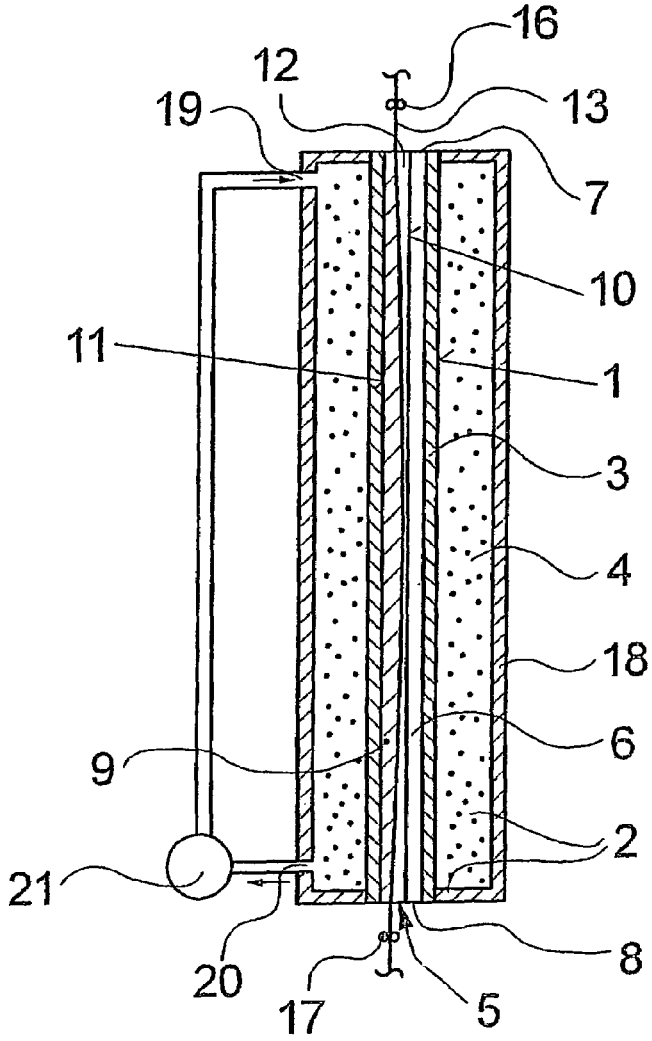
FIG. 1 is a schematic axially sectioned view of a first embodiment of the heating device according to the invention.
Figure 2:
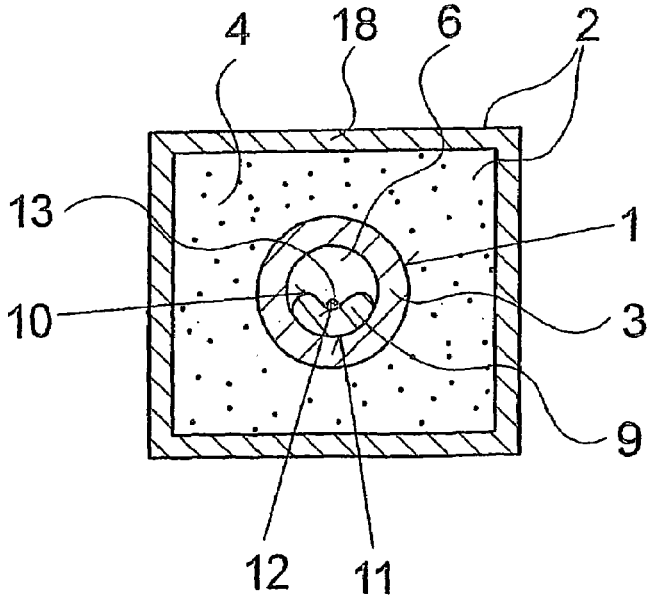
FIG. 2 is a schematic cross sectional view of the embodiment of FIG. 1.

FIG. 1 schematically illustrates an axially sectioned view of a first embodiment of the heating device according to the invention, as could be used, for example, in a texturing machine for a tension treatment of a crimped yarn in a shrinkage zone. FIG. 2 illustrates a cross sectional view of the embodiment of the heating device according to the invention. Unless express reference is made to one of the Figures, the following description will apply to both Figures.

The embodiment of the heating device according to the invention comprises an elongate heating tube 1 with a peripheral wall 3. In the present embodiment, a thin-walled tube forms the heating tube 1 with wall 3. The heating tube 1 is open at its ends.

Inside the heating tube 1, an insert 5 is arranged in the form of a special section rail 9. The special section rail 9 comprises an open long side 10 and an oppositely facing long side 11. On its open long side 10, the special section rail 9 includes a longitudinal groove 12. Between the open long side 10 of the special section rail 9 and the wall 3 of heating tube 1, a yarn channel 6 is formed, which forms on its end sides a yarn inlet 7 and a yarn outlet 8. With its long side 11, the special section rail 9 is in direct contact with the wall 3 of heating tube 1. The contact between the special section rail 9 and the wall 3 of heating tube 1 is realized such that it permits a heat transfer from the wall 3 to the special section rail 9.

On its circumference, the heating tube 1 is surrounded by a heating jacket 2. The heating jacket 2 is formed by a heater box 18, which is filled with a heat transfer medium 4. A supply line 19 and a discharge line 20 connect the heater box 18 to an evaporator 21. The discharge line 20 is arranged at a lower end, and the supply line 19 preferably at an upper end of the heater box 18. Consequently, it is preferred to arrange the heater box 18 and the heating tube 1 accommodated therein in an upright or inclined position. As a result, the condensate of the heat transfer medium 4 is removed from the heater box 18 via discharge line 20 and supplied to the evaporator 21. Within the evaporator 21, the heat transfer medium 4 is evaporated and returned to the heater box 18 via supply line 19. The heating jacket 2 that is formed by the vaporous heat transfer medium 4 and the heater box 18 uniformly heats the heating tube 1 on the circumference over the entire length of the wall 3.

However, for heating the heating tube 1, the heating jacket 2 could also be formed by electric means.

For its thermal treatment, a yarn 13 advances through the yarn channel 6 via yarn inlet 7 and yarn outlet 8. To this end, an inlet yarn guide 16 is associated with the yarn inlet 7 and an outlet yarn guide 17 with yarn outlet 8. The inlet yarn guide 16 and outlet yarn guide 17 are arranged such that the yarn 13 advances through the yarn channel 6 substantially in contact with the longitudinal groove 12 of the special section rail 9. In this process, the yarn channel 6 receives the energy that is necessary for heating the yarn 13, directly from the heating jacket 2 via the wall 3 of heating tube 1. To this end, it is preferred to make the wall 3 of heating tube 1 of a material that has an excellent thermal conductivity. With that, it becomes possible to supply the energy that is transferred from the heating jacket 2 to the wall 3 directly into the yarn channel 6 without any substantial losses.

To avoid an unacceptable contact between the yarn 13 and the wall 3 of heating tube 1, when advancing the yarn 13 in contacting relationship, the special section rail 9 is unilaterally mounted in the heating tube 1. The yarn 13 advances in the longitudinal groove 12 of the special section rail 9. At least on the surface of the longitudinal groove 12, the special section rail 9 has a wear-resistant surface. The transfer of the heat from the wall 3 into the special section rail 9 accomplishes an additional contact heating of the yarn 13 in the longitudinal groove 12. To obtain a uniform contact of the yarn 13 with the longitudinal groove 12, the longitudinal groove 12 has a curvature extending in the direction of the advancing yarn. Thus, the yarn 13 advances through the yarn channel 6 in a slight bend, which is defined by the curvature of the longitudinal groove 12.

In the embodiment of the heating device as illustrated in FIGS. 1 and 2, it is preferred to mount the special section rail 9 in the heating tube 1 in an easily exchangeable manner. With that, it is made possible to perform in a simple manner a cleaning of the special section rail 9 and in particular a cleaning of the longitudinal groove 12 that has been soiled by yarn deposits, in that the special section rail 9 is pulled out from the heating tube 1 before being cleaned and pushed into the heating tube 1 after having been cleaned.

Figure 3:
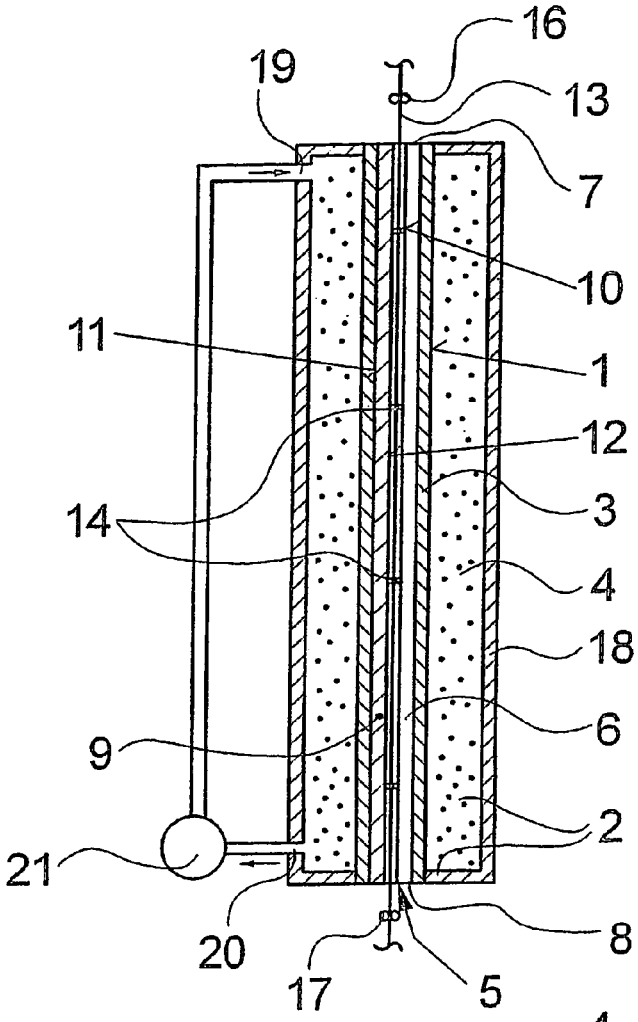
FIG. 3 is a schematic axially sectioned view of a further embodiment of the heating device according to the invention.
Figure 4:
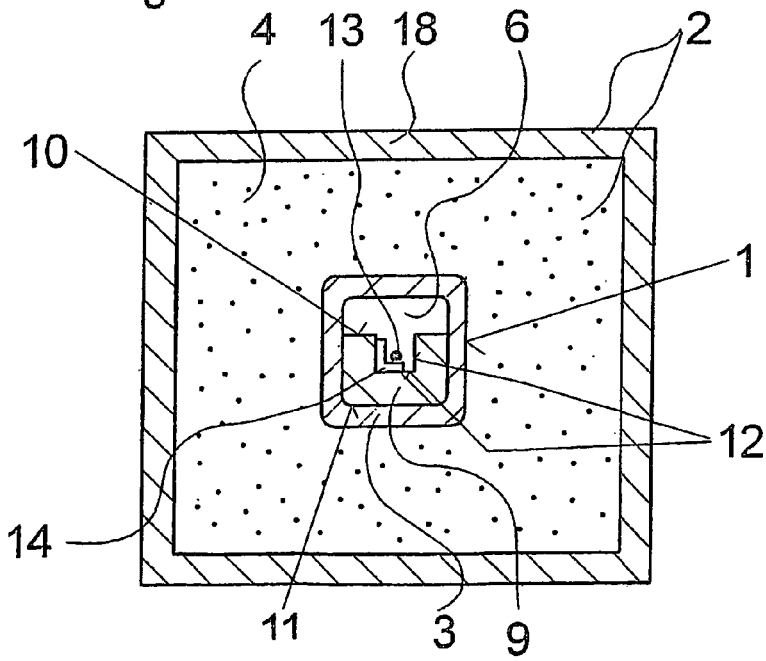
FIG. 4 is a schematic cross sectional view of the embodiment of FIG. 3.

FIGS. 3 and 4 illustrate a further embodiment of the heating device according to the invention, with FIG. 3 being a schematic longitudinally sectioned view of the heating device, and FIG. 4 a cross sectional view thereof. Unless express reference is made to one of the Figures, the following description will apply to both Figures.

The embodiment is largely identical with the foregoing embodiment of FIGS. 1 and 2. To this extent, the foregoing description is herewith incorporated by reference and only differences are described.

The embodiment of the heating device according to the invention as illustrated in FIGS. 3 and 4, is especially suited for heating a yarn substantially without contact. To this end, a special section rail 9 is arranged inside the heating tube 1. At its one open long side 10, the special section rail 9 comprises a longitudinal groove 12 that extends over the entire length of heating tube 1. Inside the longitudinal groove 12, a plurality of guide elements 14 are arranged in spaced relationship with one another. The guide elements have very short guide surfaces, along which the yarn 13 advances inside the longitudinal groove 12. The arrangement of the guide elements 14 inside the longitudinal groove 12 may be in one line, or zigzagged, or arcuate. Preferably, the guide elements 14 inside the longitudinal groove 12 of special section rail 9 are made exchangeable or adapted for variable positioning, so that they provide a high flexibility with respect to guiding and heating the yarn. It is preferred to make the guide elements 14 of ceramic materials or to provide them with ceramic coatings on their surfaces that contact the yarn 13.

In comparison with the embodiment of FIGS. 1 and 2, the heating tube 1 of the present embodiment is constructed in the shape of a rectangular solid. This permits exchanging, positioning, and mounting in a simple manner the special section rail 9 that unilaterally adjoins the wall 3.

The heating jacket 2 for heating the heating tube 1 is constructed in accordance with the foregoing embodiment by a heater box 18 and a heat transfer medium 4 filled into the heater box 18. In this arrangement, the thermal energy is largely transferred via the wall 3 of the heating tube 1 directly into the yarn channel 6.

Figure 5:
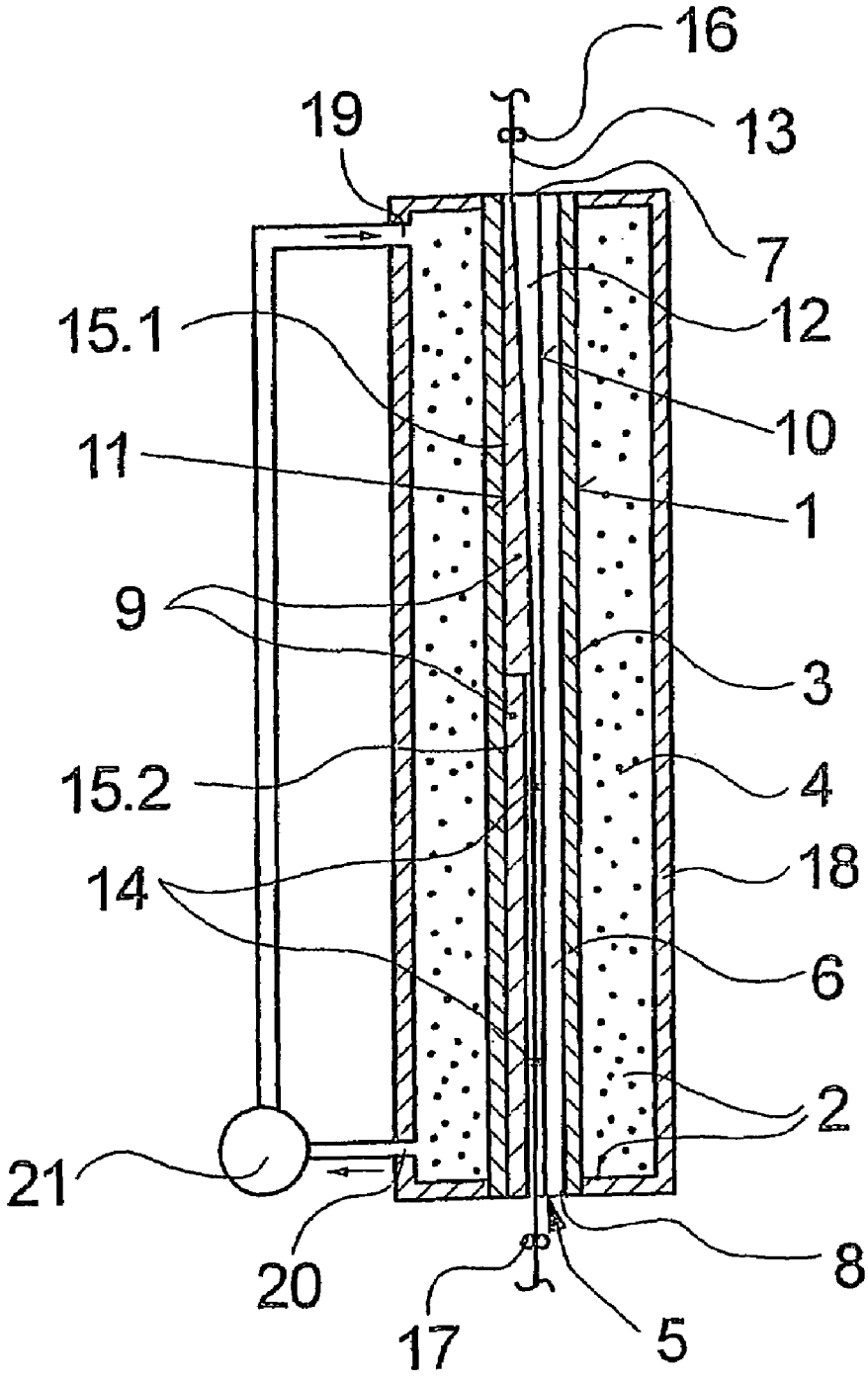
FIG. 5 is a schematic axially sectioned view of a further embodiment of the heating device according to the invention.

FIG. 5 is a longitudinally sectioned view of a further embodiment of the heating device according to the invention. The setup of the heating tube 1 and heating jacket 2 is identical with the embodiment shown in FIGS. 1 and 2. To this extent, the foregoing description is herewith incorporated by reference.

In the present embodiment, the special section rail 9 inserted into the heating tube 1 is formed by two partial lengths 15.1 and 15.2. Preferably, the partial lengths 15.1 and 15.2 are interconnected, so that they can be jointly inserted and removed. However, it its also possible to arrange the partial lengths 15.1 and 15.2 in the special section rail 9 for separate insertion and removal from both end sides of the heating tube 1. The partial length 15.1 in the special section rail 9 is made in accordance with the embodiment of FIGS. 1 and 2, and the partial length 15.2 of the special section rail 9 in accordance with the embodiment of FIGS. 3 and 4. To this extent, the respective descriptions are herewith incorporated by reference. Along the partial length 15.1, the yarn 13 advances largely in contact with the longitudinal groove 12, whereas along the partial length 15.2, the guide elements 14 guide the yarn 13 in the longitudinal groove 12 substantially in no contact therewith. Thus, two different treatment zones are formed within the heating tube 1, through which the yarn 13 advances successively.

In their setup and configuration, the embodiments shown in FIGS. 1–5 are exemplary. In this connection, a heat insulation that surrounds the heater box 18 has been omitted. In particular, it is possible to use for advancing the yarn in the heating tube any configuration of a special section rail with or without yarn guide elements. In this connection, it is important that a yarn channel be formed, which is largely heated directly through the wall of the heating tube. With that, a temperature is reached in the yarn channel, which is defined by the heating jacket. In this process, it is possible to keep transfer losses very low. A further essential advantage is the configuration of the open special section rail in such a way that it is possible to perform a rapid and effective cleaning of the surfaces contacted by the yarn after removing the special section rail from the heating tube. It is thus possible to provide both the special section rail and the guide elements thereof with any desired shape and guideway contours.

The invention claimed is:

1. A heating device for heating an advancing yarn in a yarn processing machine, comprising an elongate thin-walled heating tube which comprises a peripheral wall, a heating jacket surrounding the heating tube so that the peripheral wall of the heating tube can be evenly heated about its circumference from the outside, and an insert positioned within the peripheral wall of the heating tube so as to form a yarn channel within the tube which has a yarn inlet and a yarn outlet for guiding the advancing yarn therethrough, said insert being formed by a special section rail which includes an open long side and an oppositely facing second long side, with the yarn channel being formed between the open long side and the peripheral wall of the heating tube, and with the second long side being fitted against the peripheral wall of the heating tube.

2. The heating device of claim 1, wherein the yarn channel is widened by a longitudinal groove which extends along the open long side of the special section rail.

3. The heating device of claim 2, wherein the longitudinal groove of the special section rail has a curvature that extends in the direction of the advancing yarn.

4. The heating device of claim 2, wherein the special section rail is formed by a plurality of partial lengths that follow each other in the direction of the advancing yarn.

5. The heating device of claim 1, wherein the special section rail is exchangeably held in the heating tube.

6. The heating device of claim 1, wherein the special section rail comprises on its open long side a plurality of guide elements that are arranged in spaced relationship, and that the guide elements are exchangeable.

7. The heating device of claim 6, wherein the arrangement of the guide elements extends only over a partial length of the special section rail.

8. The heating device of claim 1, wherein the heating tube is formed by a straight or a curved tube, with the special section rail having a curvature adapted to the tube.

9. The heating device of claim 1, wherein the heating jacket comprises a heater box which is filled with a heat transfer medium which surrounds the tube.

* * * * *